US006774711B2

(12) United States Patent
Bernard

(10) Patent No.: US 6,774,711 B2
(45) Date of Patent: Aug. 10, 2004

(54) LOW POWER BANDGAP VOLTAGE REFERENCE CIRCUIT

(75) Inventor: Frederic J. Bernard, Fuveau (FR)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 10/295,974

(22) Filed: Nov. 15, 2002

(65) Prior Publication Data

US 2004/0095186 A1 May 20, 2004

(51) Int. Cl.[7] ..... G05F 1/575; G05F 1/46
(52) U.S. Cl. ..... 327/539; 323/314
(58) Field of Search ..... 327/513, 539, 327/540, 541; 323/313, 314, 315, 316

(56) References Cited

U.S. PATENT DOCUMENTS

| | | | | |
|---|---|---|---|---|
| 4,797,577 A | | 1/1989 | Hing | 327/539 |
| 5,451,860 A | | 9/1995 | Khayat | 323/314 |
| 5,670,907 A | * | 9/1997 | Gorecki et al. | 327/535 |
| 5,818,292 A | | 10/1998 | Slemmer | 327/539 |
| 5,900,773 A | * | 5/1999 | Susak | 327/539 |
| 6,157,245 A | | 12/2000 | Rincon-Mora | 327/539 |
| 6,249,031 B1 | | 6/2001 | Verma et al. | 257/378 |
| 6,281,743 B1 | | 8/2001 | Doyle | 327/539 |
| 6,529,066 B1 | * | 3/2003 | Guenot et al. | 327/539 |
| 2003/0030482 A1 | * | 2/2003 | Mori | 327/540 |

* cited by examiner

*Primary Examiner*—Timothy P. Callahan
*Assistant Examiner*—Terry L. Englund
(74) *Attorney, Agent, or Firm*—Thomas Schneck

(57) ABSTRACT

A bandgap voltage reference circuit that utilize a two-stage transconductance amplifier as a feedback control loop to improve the accuracy and stability of the output reference voltage without the need for an additional biasing circuit. The high gain provides a good power-supply rejection ratio, and improves the circuit performance. The amplifier does not require a biasing circuit, thus saving valuable chip space. Furthermore, eliminating the need for a biasing circuit reduces the power consumption of the circuit.

13 Claims, 2 Drawing Sheets

LOW POWER BANDGAP VOLTAGE REFERENCE CIRCUIT

TECHNICAL FIELD

The present invention generally relates to circuits that provide a temperature independent reference voltage, and more specifically, to bandgap voltage reference circuits.

BACKGROUND ART

In an integrated circuit, a bandgap reference circuit provides a substantially constant reference voltage output that is immune to variation in fabrication process, operating temperature, and supply voltage. The bandgap reference circuit makes use of the predictable behavior of bandgap energy of semiconductor material. A typical bandgap reference circuit employs a semiconductor bipolar pn junction (diode) device that has a negative temperature coefficient (i.e. its output voltage falls with rising temperature), and complements it with a pair of bipolar junction devices, each having a different emitter cross-sectional area, that generates a voltage difference that has a positive temperature coefficient, thereby producing a voltage output that is invariant to temperature change. FIG. 2 shows a typical voltage reference of the prior art. As shown, the reference circuit 10 could be viewed as having been constructed with three functional components: a proportional-to-absolute-temperature (PTAT) block 14 that provides a positive temperature coefficient, a diode connected bipolar junction transistor 16 that provides a negative temperature coefficient, and a current mirror 12 that joins PTAT block 14 and the bipolar junction transistor 16 together. The PTAT block 14 is made up of a first and second bipolar junction transistors 18 and 20 connected together at their bases, the first bipolar junction transistor 18 having an emitter cross-sectional area that is only a fraction of the second one. The current mirror block 12, which consists of NMOS transistors 26, 28, and 30, mirrors the current flowing though the PTAT block 14 to the diode connected bipolar junction transistor 32. Due to the differential in emitter cross-sectional area between the first bipolar junction transistor 18 and the second bipolar junction transistor 20, the current density going through each transistor differs, which gives rise to the effect that each transistor would have a different base-to-emitter voltage (Vbe). The difference between the respective base-to-emitter voltages, denoted as ΔVbe, can be derived by one skilled in the art to be:

$$\Delta V_{be} = \frac{kT}{q}\ln X$$

where k is the Boltzmann's constant, T is the absolute temperature, q is the electrical charge, and X is the scaling factor of the emitter cross-sectional area. As shown in the equation above, the term ΔVbe is directly proportional to the absolute temperature T. The reference current I 36 can then be expressed as $$I = \frac{V_{R1}}{R1} = \frac{\Delta V_{be}}{R1} = \frac{kT\ln X}{qR1}$$

Since the current I 36 is also mirrored to the branch with the diode connected bipolar junction transistor 32, the output reference voltage 34 can be expressed as $$V_{ref} = V_{be} + IR_2 = V_{be} + \frac{R_2}{R_1}\frac{kT\ln X}{q}$$

As it is shown in the equation above, the reference voltage Vref 34 is a function of the Vbe of the diode connected bipolar junction transistor 32 and the $\Delta V_{be}$ of the first and second bipolar junction transistors 18 and 20, scaled by the ratio of R2 and R1.

A more robust prior art bandgap voltage reference circuit, which is shown in FIG. 3, employs an operational amplifier 40 to take the place of the current mirror 12. The op amp 40 provides a feedback control loop pathway that keeps the two input nodes of the amplifier 40 at approximately the same voltage in the steady state. In so doing, the voltage difference $\Delta V_{be}$ between the two diodes, $D_1$ and $D_2$, is amplified, which contributes to its higher accuracy. However, the higher accuracy comes with penalties in the form of added circuit complexity and increased power consumption as a typical op amp requires a biasing circuit that draws additional power and takes up additional space. It is the object of the present invention to have a bandgap voltage reference circuit that gets the benefit of having an op amp while at the same time does not substantially increase the circuit complexity and power consumption.

SUMMARY OF INVENTION

The above object of the present invention has been achieved by a bandgap voltage reference circuit that incorporates a unique 2-stage transconductance amplifier into a feedback control loop to improve the reference voltage accuracy and stability without the need for a biasing circuit. Having a high gain circuit gives the present invention a good power supply rejection ratio, and, contributes to its higher accuracy and stability. The elimination of the bias circuit provides the present invention with low power consumption and less circuit complexity.

BEST MODE FOR CARRYING OUT THE INVENTION

Figure 1:
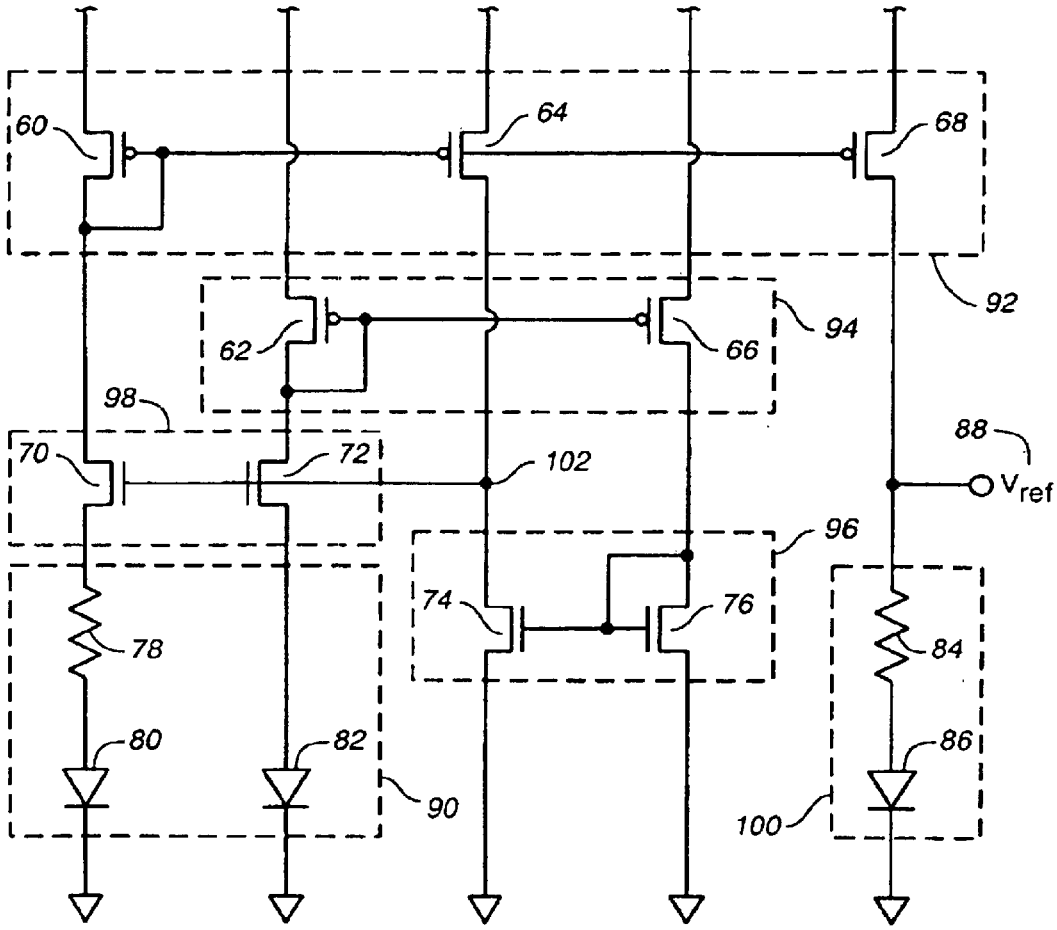
FIG. 1 is a circuit diagram of a bandgap voltage reference circuit of the present invention.
Figure 2:
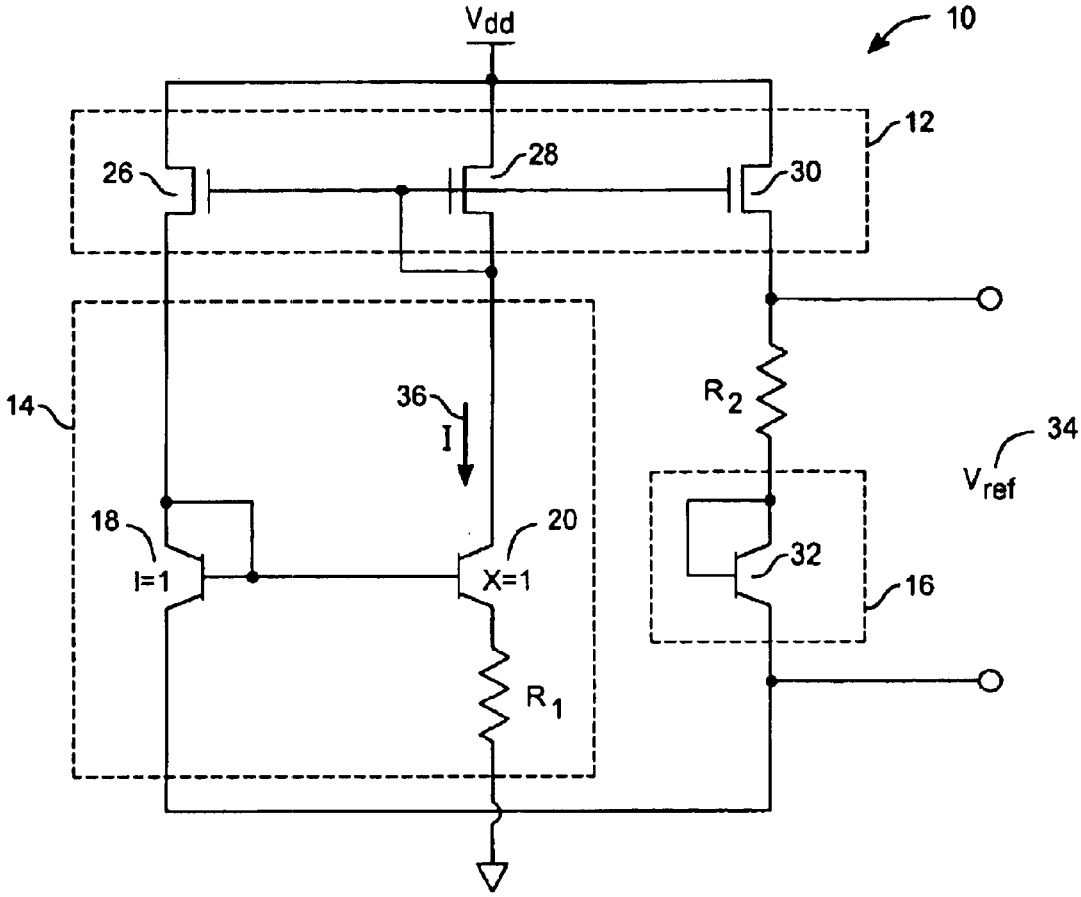
FIG. 2 (PRIOR ART)
FIG. 2 is a circuit diagram of a bandgap voltage reference circuit of the prior art.
Figure 3:
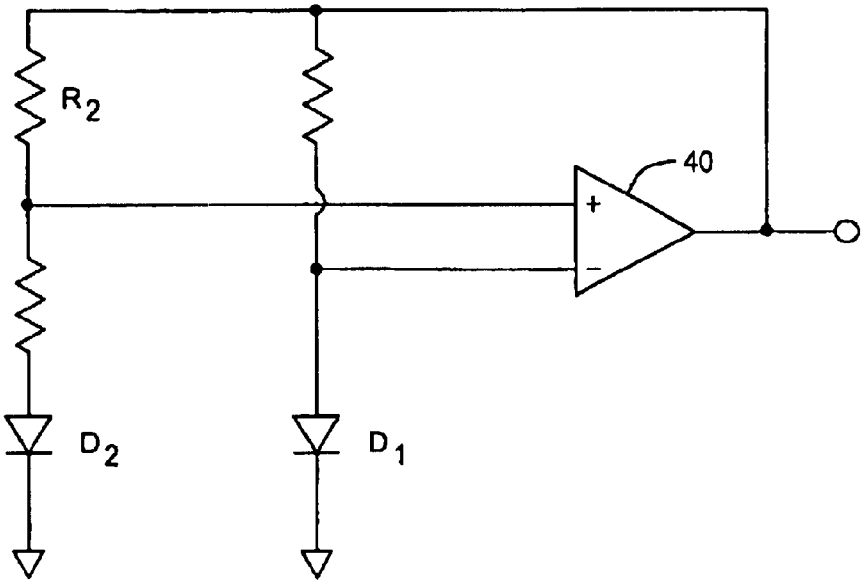
FIG. 3 (PRIOR ART)
FIG. 3 is a circuit diagram of another bandgap voltage reference circuit of the prior art.

With reference to FIG. 1, the bandgap voltage reference circuit of the present invention is composed of a proportional-to-absolute-temperature (PTAT) circuit 90, a first stage amplifier consisting of a first current mirror 92, a second current mirror 94, and a third current mirror 96, a second stage amplifier 98, and a reference voltage output block 100. The PTAT circuit 90, which contributes to the positive temperature coefficient, is made up of a first and second diode 80 and 82 and a first resistor 78, each of the diodes having a different emitter cross-sectional area. The term, diode, is being used herein generally to denote any device that behaves like a forward biased semiconductor P-N junction device. A typical example of such a device would be a diode connected bipolar junction transistor. The negative terminals of the diodes 80 and 82 are connected to a power ground while the positive terminal of the first diode 80 is connected to the source of a first NMOS transistor 70 through the first resistor 78. The positive terminal of the second diode 82 is connected to the source of a second NMOS transistor 72. The drain of the first NMOS transistor is connected to a first current mirror 92 having a first PMOS transistor 60, a second PMOS transistor 64, and a third PMOS transistor 68. The drain of the second NMOS transistor 72 is connected to a second current mirror 94 that includes a fourth and fifth PMOS transistors 62 and 66. The source of each of the PMOS transistors 60, 62, 64 and 66 is connected to a power supply. The drain of the second PMOS transistor 64 in the first current mirror 92 is connected to a third current mirror 96 made up of a third and fourth NMOS transistors 74 and 76. The drain of the second PMOS transistor 64 is also connected to the second amplifying stage through the gates of the first and second NMOS transistors 70 and 72. The drain of the PMOS transistor 66 is connected to the drain of the fourth NMOS transistor 76. The sources of the third and the fourth NMOS transistors are both connected to the power ground. The drain of the third NMOS transistor 74 is connected to the drain of the second PMOS transistor 64 in the first current mirror and the gates of the first and second NMOS transistor 70 and 72. The drain of the third PMOS transistor 68 of first current mirror is connected to the positive terminal of a third diode 86 through a second resistor 84. The bandgap reference voltage Vref 88 is the voltage across the second resistor 84 and the third diode 86.

In the preferred embodiment, the diodes used in the PTAT circuit are bipolar function transistors fabricated out of n-well process using vertical PNP configurations. The advantage of using such a device is that the manufacturing process is fully compatible of standard CMOS process. In addition, vertical PNP provides a device that is stable with regard to process variation. In one embodiment, the first diode 80 has an emitter cross-sectional area that is 24 times greater than that of the second diode 82. As the current flowing through each diode at steady state is more or less the same, the current density in the second diode 82 would be 24 times greater than that of the first diode 80. As a result, the difference between the $V_{be}$ of the first and second diodes is equal to $V_T \ln 24$, where $V_T$ is the thermal voltage of the vertical pnp transistors, which is function of Boltzmann's constant, absolute temperature and electrical charge. The voltage different $\Delta V_{be}$ is being transmitted to the reference output 88 through a current mirror set up composing of the first PMOS transistor 60 and the third PMOS transistor 68.

It should be apparent from the above description that an accurate and stable output voltage reference depends on an accurate and stable reference current going through the first diode 80. And since the reference current is a reflection of the voltage difference between the first and second diode 80, 82, the more equal the current flowing through the two diodes, the more accurate the reference current. This job of maintaining the equal current flowing through each diode is performed by the 2-stage transconductance amplifier. The 2-stage transconductance amplifier forms a feedback control loop using the first and second current mirror 92, 94, and the first, second, third and fourth NMOS transistor 70, 72, 74, 76. The first and second current mirrors 92, 94 sample the current flowing through the first and second diodes 80, 82. Their difference is being tapped off from a common node 102 and is fed into the gates of the first and second NMOS transistor, which regulates the current through each diode. The amplifying effect of the amplified control feedback loop further improves the power supply rejection ratio, thereby improving the stability and accuracy of the reference voltage. However, unlike the bandgap voltage reference circuits of the prior art that uses an op amp for the amplification effect, the present invention does not require a biasing circuit. A biasing circuit is typically made up of a plurality of additional transistors, which takes up valuable chip space and consumes power. Thus, the circuit of the present invention provides the advantage of consuming less power and taking up less die area than the circuits of the prior art.

What is claimed is:

1. A bandgap voltage reference circuit comprising:

a proportional-to-absolute-temperature (PTAT) module for generating a first PTAT current and a second PTAT current;

a first amplifier stage comprising a first NMOS transistor having a drain that is coupled to said PTAT module through a first current mirror for receiving said first PTAT current, a gate of said first NMOS transistor coupled to a gate of a second NMOS transistor, said second NMOS transistor having a drain that is coupled to said PTAT module through a second current mirror for receiving said second PTAT current, said drain of said second NMOS transistor also couples to its gate, a source of each of said first NMOS transistor and said second NMOS transistor couples to a ground;

a second amplifier stage coupled to said first amplifier stage and said PTAT module for receiving an amplified signal from said first amplifier stage and transferring said amplified signal back to said PTAT module; and an output circuit coupled to said PTAT module for receiving said first PTAT current and for generating a reference voltage that does not change with temperature.

2. The bandgap voltage reference circuit of claim 1, wherein said output circuit comprises a first bipolar junction device having a positive terminal and a negative terminal, said positive terminal being coupled to said PTAT module to receive said first PTAT current through a first resistive element while said negative terminal is coupled to said ground.

3. The bandgap voltage reference circuit of claim 2, wherein the PTAT module comprises second and third bipolar junction devices that carry said first PTAT current and said second PTAT current respectively, each having a different emitter cross-sectional area, and each bipolar junction device having a positive terminal and a negative terminal, said positive terminal of said second bipolar junction device being coupled to the second amplifier stage through a second resistive element, said positive terminal of said third bipolar junction device being coupled to said second amplifier stage, said negative terminals being coupled to said ground, each of the second and third bipolar junction devices has a different voltage drop and the difference between said voltage drops providing a voltage reference that increases with increasing temperature.

4. The bandgap voltage reference circuit of claim 3, wherein said second amplifier stage comprising a third NMOS transistor and a fourth NMOS transistor each having a gate that is coupled to said drain of said first NMOS transistor, said third NMOS transistor having a source coupled to said positive terminal of said second bipolar junction device through said second resistive element, said fourth NMOS transistor having a source coupled to said positive terminal of said third bipolar junction device, said third NMOS transistor and said fourth NMOS transistor each having a drain that is coupled to said first amplifier stage through said first current mirror and said second current mirror respectively.

5. The bandgap voltage reference circuit of claim 3, wherein the bipolar junction devices are diodes.

6. The bandgap voltage reference circuit of claim 3, wherein the bipolar junction devices are diode connected transistors.

7. A bandgap voltage reference circuit comprising:

first and second bipolar junction devices, each having a positive terminal and a negative terminal, and each having a different emitter cross-sectional area, each of the first and second bipolar junction devices having a different voltage drop, the difference between said voltage drops providing a first reference voltage that increases with increasing temperature, said negative terminals of the first and second bipolar junction devices being connected to ground;

a feedback control loop having a 2-stage transconductance amplifier coupled to the positive terminals of the first and second bipolar junction devices wherein a first stage in said 2-stage transconductance amplifier comprises a first NMOS transistor having a drain that is coupled to said positive terminal of said first bipolar junction device through a first current mirror, a gate of said first NMOS transistor coupled to a gate of a second NMOS transistor, said second NMOS transistor having a drain that is coupled to said positive terminal of said second bipolar function device through a second current mirror, said drain of said second NMOS transistor also coupled to its gate, a source of each of said first NMOS transistor and said second NMOS transistor couples to ground, whereby the current flowing through the first and second bipolar junction devices is maintained at substantially the same level;

a first resistive element having a first terminal coupled to receive the current flowing through the first bipolar junction device, wherein the first reference voltage with a positive temperature coefficient is duplicated in the voltage drop across said first resistive element; and a third bipolar junction device having a positive terminal and a negative terminal, said positive terminal being coupled, in a serial manner, to a second terminal of said first resistive element, said negative terminal being coupled to ground, wherein a second reference voltage having a negative temperature coefficient is provided across the positive and the negative terminals of the third bipolar junction device;

whereby an output reference voltage that is stable irrespective of temperature is provided as a voltage drop across said first resistive element and the third bipolar junction device.

8. The bandgap voltage reference circuit of claim 7, wherein a second stage in the said two-stage transconductance amplifier comprises:

a third NMOS transistor and a fourth NMOS transistor each having a date that is coupled to said drain of said first NMOS transistor, said third NMOS transistor having a source coupled to said positive terminal of said first bipolar junction device, said fourth NMOS transistor having a source coupled to said positive terminal of said second bipolar junction device, a drain of said third NMOS transistor and a drain of said fourth NMOS transistor coupled to said first stage of said two-stage transconductance amplifier through said first current mirror and said second current mirror respectively.

9. The bandgap voltage reference circuit of claim 7, wherein the bipolar junction devices are diodes.

10. The bandgap voltage reference circuit of claim 7, wherein the bipolar junction devices are diode connected transistors.

11. A bandgap reference voltage reference circuit comprising:

a first bipolar junction device and a second bipolar junction device, each having a different emitter cross-sectional area, each having a positive terminal and a negative terminal, wherein the negative terminals of both bipolar junction devices are coupled to a power ground, the positive terminal of the first bipolar junction device being coupled to a terminal of a first resistive element, while the other terminal of the first resistive element being, coupled to a source electrode of a first NMOS transistor, the positive terminal of the second bipolar junction device being coupled to a source electrode of a second NMOS transistor, a gate electrode of which is coupled to a gate electrode of the first NMOS transistor, to form a common node;

a first current mirror circuit mirroring a first current flowing through the first bipolar junction device and the first NMOS transistor into a first branch and a second branch, said first branch being coupled to said power ground through a third NMOS transistor, said second branch being coupled to a second resistive element and a third bipolar junction device in series, said third bipolar junction device having a positive terminal and a negative terminal, said positive terminal being coupled to the second resistive element, said negative terminal being coupled to said power ground; and a second current mirror circuit mirroring a second current flowing through the second bipolar junction device and the second NMOS transistor to said power ground through a fourth NMOS transistor, said third and fourth NMOS transistors each having a gate, a source and a drain, wherein the drain of the fourth NMOS transistor being coupled to the gates of the third and fourth NMOS transistors, and the drain of third NMOS transistor being coupled to the gates of the first and second NMOS transistors; whereby a reference voltage is provided across the serial connection of the second resistive element and the third bipolar junction device.

12. The bandgap voltage reference circuit of claim 11, wherein the bipolar junction devices are diodes.

13. The bandgap voltage reference circuit of claim 11, wherein the bipolar junction devices are diode connected transistors.

* * * * *